United States Patent [19]

Chaussé et al.

[11] Patent Number: 4,595,813

[45] Date of Patent: Jun. 17, 1986

[54] INDUCTION HEATING APPARATUS FOR MOVING METAL PRODUCTS

[75] Inventors: Bernard Chaussé, Antony; Jean Hellegouarc'h, Le Perreux sur Marne; Jean Maurice, Paris, all of France

[73] Assignee: CEM - Compagnie Electro-Mecanique, Paris, France

[21] Appl. No.: 620,210

[22] Filed: Jun. 13, 1984

[30] Foreign Application Priority Data

Jun. 13, 1983 [FR] France ..... 83 09723

[51] Int. Cl.[4] ..... H05B 5/00; H05B 6/64

[52] U.S. Cl. ..... 219/10.71; 219/10.69; 219/10.75

[58] Field of Search ..... 219/10.69, 10.71, 10.79, 219/10.67, 10.75

[56] References Cited

U.S. PATENT DOCUMENTS 3,008,026 11/1961 Kennedy ..... 219/10.69
3,471,673 10/1969 Frostick ..... 219/10.69
3,489,875 1/1970 Ross ..... 219/10.69
3,715,556 2/1973 Balzer et al. ..... 219/10.69
4,321,449 3/1982 Courdille ..... 219/10.71

FOREIGN PATENT DOCUMENTS 1182373 5/1963 Fed. Rep. of Germany .
2306269 10/1976 France .
2473244 7/1981 France .
2495752 6/1982 France .

*Primary Examiner*—Roy N. Envall, Jr.
*Assistant Examiner*—M. M. Lateef
*Attorney, Agent, or Firm*—Sughrue, Mion, Zinn, Macpeak and Seas

[57] ABSTRACT

The rollers (2) carrying a steel strip (1) to be heated between two rolling mill procedures are mainly constituted by a lamination of magnetic sheet metal plates to channel the variable magnetic flux generated by inductors which consist of magnetic circuits (4) and field coils (5), and so that the rollers are not heated up by this flux.

6 Claims, 15 Drawing Figures

INDUCTION HEATING APPARATUS FOR MOVING METAL PRODUCTS

FIELD OF THE INVENTION

The present invention relates to an induction heating apparatus for moving metal products.

BACKGROUND OF THE INVENTION

Such an apparatus may comprise the following known elements:

conveyance rollers to bear and to carry along the products to be heated according to a longitudinal and notably horizontal direction; these rollers coming one after the other, according to this longitudinal direction and rotating around shafts which are parallel to a transverse and notably horizontal direction, perpendicular to this longitudinal direction; and wherein they are supported by end bearings, induction coils supplied with electric current to generate a periodically variable magnetic flux, and a looped magnetic circuit constituted at its top section by high magnetic conductivity elements and by, at its bottom section, the product to be heated to channel this flux by forming flux loops which pass twice upwards and downwards through the product to be heated, and which close longitudinally, on top of and under this product, the rollers being made of composite material and including each a magnetic stack and a stiffening element; the magnetic stack taking at least half of the roller volume and being made of high magnetic conductivity elements stacked according to the roller axis so that the roller makes out part of the said looped magnetic circuit; the stiffening element being metallic, resists to at least the tension strains and extends, according to the said transverse direction, on the whole roller length inside the magnetic stacking to that the roller resists to the bending strains generated by the weight of the product to be heated.

A first known apparatus including such elements, is described in the U.S. Pat. No. 3,008,026 (Kennedy). According to this patent, the magnetic stack of each conveyance roller is constituted by thick removable disks which may have different magnetic conductivity values to allow suitable distribution of the heating magnetic flux according to the thickness of the product to be heated. The rollers are arranged by pairs above and under the product to be heated and their magnetic disks are in contact with this product. The induction coils surround the rollers, above and under the product to be heated, in order to ensure symmetric flux distribution. These rollers are in contact with the product to prevent any vertical movement due to the magnetic forces created by the heating flux.

As will be understood by those skilled in this art, this first known apparatus is exclusively designed for heating of a thin strip at a low temperature which is likely to be under 500° C., even if this patent mentions heat treating and forming as possible applications of the invention. As a matter of fact, the heating power seems rather weak because of the coil arrangement and because a high flux would raise the temperature of the magnetic disks beyond their Curie point, thus entailing loss of their magnetic conductivity. Such a flux would also heat indirectly the shafts which make out the stiffening elements of the rollers, since these shafts are normally of steel presenting a sensitive magnetic conductivity and would therefore be crossed by such flux. By such heating, these shafts would loose part of their mechanical properties. Heating of these shafts and disks is more important as no thermal insulation is provided between the product to be heated and the conveyance rollers. At last, maintenance of such an apparatus would be costly since there are coils under a very hot product which might entail fall of hot fragments such as oxidation flakes.

In view of the above, the Kennedy patent, for those skilled in the art, does not seem to give useful indications for cases where heavy and thick products are to be heated at high temperature.

On the contrary, the present invention applies to cases where thick metal products are to be heated or warmed up to a high temperature, in order, for example, to facilitate further distortion. It more specially applies to cases where these products are long steel industry products, as for example, flat steel products, which are still hot during rolling procedures, and which have to be heated up to a temperature of about 1000° to 1200° C. to allow continuation of the rolling process in good conditions. The thickness of such products can, for instance, be included between about 25 and 250 mm, and the power which must be dissipated to heat such products can be included between about 10 and 200 W/cm1. This dissipation results from the fact that the product is crossed by the variable magnetic flux generated by an inductor and that this product is electrically conductive. Since its temperature is above the Curie point, which varies according to the alloys while always remaining under 770° C., the product is prevented from being ferromagnetic. However the products could sometimes be aluminium plates or other nonmagnetic metals to be held at the correct rolling temperature.

It is precised that heating of such products can be obtained by a flux passing through the smaller dimension or thickness of the flat product. For what concerns the necessary flux variation, it can be obtained by period variation, for example, sine-shaped, of an inductive current in stationary coils. It can also be obtained by longitudinal or transverse displacement of drift field waves generated by a stationary multiphase inductor. It can also result from periodic reluctance variation of a DC-energized magnetic circuit, or by mechanical displacement of DC-energized fields.

For known industrial apparatus using roller conveyors associated with high power and high induction power heating components, these components are installed between the rollers so that the latter are as far as possible from the variable fluxes and so that they are not heated. There is no intermediate support plate between the rollers to bear the product to be heated. This is for example, the case of the apparatus as for the English Pat. No. 1 453 483 filed Mar. 7, 1974 (the Electricity Council, inventor: Ralph Waggott) or the apparatus as for the U.S. Pat. No. 3,471,673, inventor: Harold Grote Frostick.

These second and third known apparatus have the disadvantage of the heating power supplied by the inductors which is limited by the confined space available between the conveyance rollers or near the latter for passage of the variable magnetic flux. If such flux is vertical, this power is often notably weak because of the lack of intermediate support plates. This allows only small intervals between rollers if the temperature of the product to be heated reduces its bending strength between rollers.

It was proposed to increase the heating power of these second and third known apparatus by enlarging their length according to the conveyance direction. However this does not only increase the cost of the apparatus but also that of the buildings which have them. In addition the thermal losses are increased and it costs more to reach the temperatures required for the product to be heated.

It was also proposed, in order to increase the heating power without enlarging the length of the heating apparatus, to augment the frequency of the magnetic flux variation. Indeed it is known that the electromotive forces induced inside the material to be heated are proportional to such frequency and that, for a flux variation amplitude unchanged at all points, the power dissipated in such material increases as the square of the frequency. However the search for increased frequency is limited by the fact that the variable flux only penetrates on a restricted thickness of the material to be heated and that such thickness decreases as the frequency increases. Moreover, the use of a high frequency creates, above all, important losses in the magnetic circuit of the inductor and makes necessary the use of a poor efficiency current generator. Therefore the cost of the power supplied to the material to be heated, embarassingly increases.

Besides, the cost for construction of the known apparatus is increased by the fact that the magnetic circuit must strictly channel the fluxes in predetermined intervals.

SUMMARY OF THE INVENTION

The present invention is designed to allow high temperature heating of moving metal products with increased power, using a simple apparatus, easy to maintain, without any dimensional enlargement, and which only consumes electrical power at a moderate frequency, as for example, that of the mains, i.e. 50 to 60 Hz.

It is specially intended to allow economical integration of a heating apparatus for metal prooducts, including the hereabove mentioned known elements;

This apparatus is characterized by the fact that the magnetic stack is a laminated stacking constituted by magnetic sheet metal layers, of which thickness is not superior to 0.6 mm, electrically resistant, and isolated from each other so that the magnetic flux passing through the stage cannot heat it beyond the Curie point of these magnetic plates even when the product is heated beyond 800° C.

The stiffening element is constituted by a non magnetic metal so that the magnetic flux through the roller is channelled by the magnetic stack on both sides of this stiffening element and cannot heat the latter up to a temperature which might damage its mechanical properties;

Each conveyance roller includes, in addition, shielding cans distributed on the whole roller length, consisting of refractory nonmagnetic steel and presenting a circular bearing edge coaxial to the roller and radially located beyond the magnetic stack to keep a radial thermal insulation interval between this stack and the product to be heated, born by a bearing edge.

An empty interval for thermal insulation is arranged between the upper side of the product to be heated and a magnetic inductor circuit which makes out the section of the said looped magnetic circuit above the product and which is the only one fitted with the said induction coils.

The sheet metal plates used for the roller magnetic stacks are of the conventional type used for laminated magnetic circuits and which usually are 0.5 mm thick.

In addition, the apparatus preferably includes stationary intermediate support plates arranged in gaps between the successive conveyance rollers to limit downward bending of a long and more or less flexible product. These intermediate support plates include ferromagnetic blocks constituted by transverse stacking of magnetic sheet metal plates normal to this transvere and intended to complete, with the said conveyance rollers, the looped magnetic circuit under the product to be heated. In the same way, each intermediate support plate preferably includes refractory nonmagnetic steel shielding cans distributed along the transverse direction and protruding above the said ferromagnetic blocks to separate the product to be heated and make out a thermal insulation in relation to such blocks.

It appears that the invention allows the combination of the conveyance and of the heating mans without hindering in any way operation of one of them, thus eliminating the previous disadvantage.

The teachings of this invention show that the apparatus employs rollers and possibly a new kind of intermediate support plate, specially using laminated mgnetic sheet metal and than it can easily be adapted to special operating conditions of the mechanical, magnetic or thermal type. This allows to supply to the products induction fluxes presenting no discontinuity in the products moving direction. Thus, this invention allows the highest possible linear power and therefore gives important compacity to the heating components. Therefore it facilitates economical integration of the heating apparatuses in the existing or future rolling plants in which the required heating powers can reach several tens of megawatts.

These advantages and the specificities of the invention will be understood better after reading the following description, based on non limitative examples illustrated by the enclosed figures. On these figures, the laminated metal elements have partial hatching directed according to the plane of the sheet metal plates which make out such elements and include no hatching when such planes are parallel to that of the sheet.

DESCRIPTION OF PREFERRED EMBODIMENTS

Figure 1:
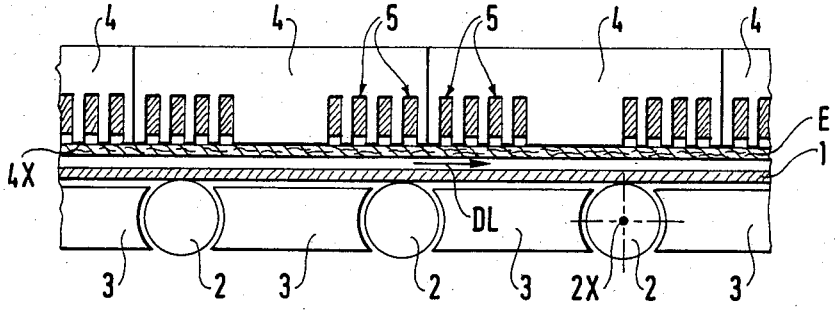
FIG. 1 is a side elevation with partial vertical cross-section, of a first construction of the invention with distributed single-phase induction winding having overlapping heads supplied with alternative current.
Figure 2:
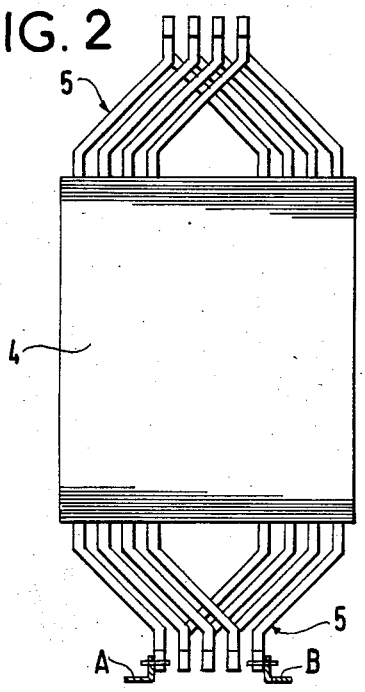
FIG. 2 is a plan view of an inductor shown in FIG. 1.
Figure 3:
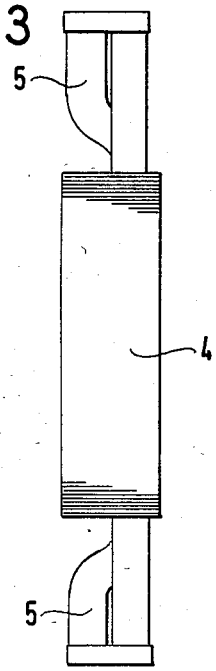
FIG. 3 is a side view of an inductor shown in FIG. 1.

The first preferential construction mode for the invention is shown in FIG. 1. The product to be heated 1 is driven by roller 2 and moves on top of the intermediate support plates 3. Laminated magnetic circuits 4 make out a longitudinal sequence. They bear, in notches, induction windings 5 generating the heating flux. The windings are pulsed stator windings, which means that they are stationary in space and variable in time, at any point of the product. As shown on the plan view of FIG. 2 and on the end view of FIG. 3, relating to these same inductors and emphasizing the lamination direction, their winding is of the simple-phase type with overlapping heads and is supplied with mains frequency (50 or 60 Hz) alternative current via terminals A and B. The inductors are protected from the thermal radiation of the heated product by a shield E made of, for example, 5 cm thick ceramic fiber. In this arrangement, rollers 2 and intermediate support plates 3 are designed to have important magnetic conductivity while being the seat of limited losses by Eddy currents and magnetic hysteresis and while preserving the mechanical abilities required for conveyance of the products to be heated.

Figure 4:
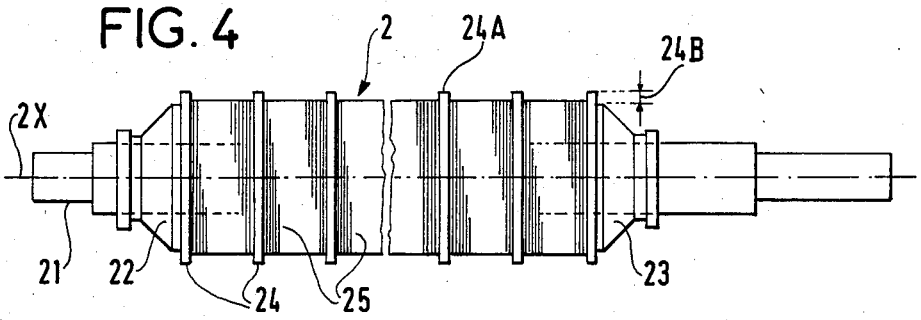
FIG. 4 is a front view of a conveyance roller in FIG. 1, to show that such roller is laminated transversely to its axis.

According to FIG. 4 and as a non limitative example, the rollers are constructed by stacking, on a rigid shaft 21, between two clamping flanges 22 and 23, a succession of nonmagnetic refractory steel shielding cans 24 and laminated magnetic blocks 25. Each block is constituted by a stack of flat disk-like sheet metal plates. The insulation between sheet metal plates is obtained by oxidizing their surface. The blocks and shielding cans stack is clamped between flanges 22 and 23 and shaft 21 tensioned so that the stack participates in the roller overall stiffness.

Each shielding can 24 shows a circular bearing edge 24A, coaxial to the roller and radially positioned beyond these blocks to maintain a radial thermal insulation gap 24B between these blocks and the product to be heated which is supported by this bearing edge.

Figure 5:
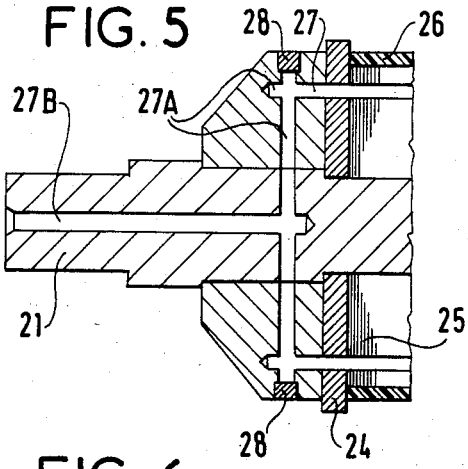
FIG. 5 is an end sectional view of a conveyance roller cooled by fluid circulation which can be used instead of the roller shown in FIG. 4.

The rollers design can be adapted to each operating case. For example, in less severe thermal conditions determined by colder products or products moving at low speed, the shielding cans 24 may be made of more ordinary steel or even be suppressed and the magnetic circuits may be insulated using electric varnish. On the contrary, for severe thermal conditions, which jeopardize the yield strength of the constituents or which might bring the magnetic circuits to a temperature above their Curie point where they would loose their magnetic conductivity, it may be necessary to cool the rollers. Cooling can be ensured by water spraying booms. As shown on FIG. 5, it is also possible to isolate the magnetic blocks 25 by insulating cylindrical rings 26 made of melt silica, surrounding these blocks and to provide cooling by coolant circulation - air, water or other fluids—in channels 27 parallel to the axis. According to this figure, blanking plugs 28 are required at the end of radial channels 27*a* obtained by drilling and supplying channels 27 from the axial channels 27*b*.

Figure 6:
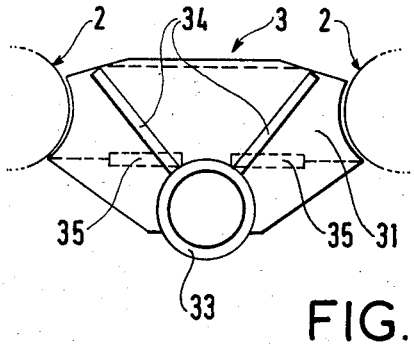
FIG. 6 is an end view of an intermediate support plate transversely laminated, shown in FIG. 1.
Figure 7:
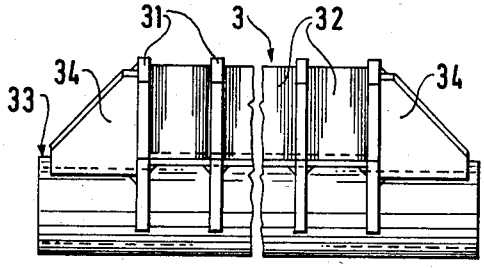
FIG. 7 is an end view of the same intermediate suppor plate

According to FIGS. 6 and 7, a non limitative example shows how the intermediate support plates are constructed by stacking shielding cans 31 made of refractory nonmagnetic steel, and laminated magnetic blocks 32, the whole assembly being mounted and stiffened by mechanically welded elements 33, 34 and 35.

Shape, dimension and material changes can of course be adapted to preserve or improve the mechanical behaviour and the magnetic conductivity of the rollers and intermediate support plates according to the thermal conditions. In particular, the cooling systems previously described for the rollers, can be directly adapted to these intermediate support plates.

FIG. 1, shows that the sequence of rollers and intermediate support plates constitutes a quasi-continuous magnetic circuit. The air gaps between rollers and support plates may indeed have a thickness of about 1 centimeter, they do not significantly increase the reluctance of the total magnetic ciucuit and, in practice, they eliminate risks of rollers jamming due to disturbing elements such as scale scraps. This arrangement is designed so that the main air gap (of about one or several decimeters) met by the inductor flow is the one made out by the vertical thickness of the product, the air above it and the inductor thermal protection. It allows easy channelling of the heating flux and eliminates, when designing the inductors, the problems related to presence and position of rollers and intermediate support plates. On FIG. 1, the sequencing pitch of the rollers is inferior or equal to that of the rollers, but it obviously could be inferior or equal to it.

FIG. 1 shows an inductor construction in one pitch, or one pole, modules; this construction is not a necessity, but rather a convenience. It is always possible to make out multi-pole modules or to have all the inductors in one single unit. According to this figure, the magnetic circuit 4 shows a longitudinal succession of 4X polar teeth extending vertically and ending downwards, opposite the product to be heated and connected by their summits, whereas the induction coils induce in these teeth a vertical variable magnetic flux.

Figure 8:
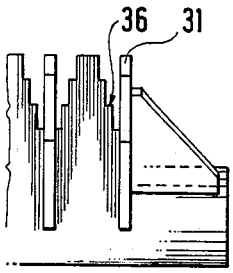
FIG. 8 is an end view of an intermediate support plate able to evacuate the scale and which can be used instead of the support plates shown in FIGS. 6 and 7.

FIG. 8 is a plan view of the intermediate support plates showing a stepped construction of sheet metal plates 36 in the magnetic blocks of the intermediate support plates to make for a gap, between these blocks and the shielding cans 31, from which the scale which forms on the product to be heated, can evacuate or be evacuated by external means. Of course other arrangements can allow this scale evacuation.

In this first construction mode, the product to be heated is constituted, for example, by a flat steel strip from rolling mill. This strip is, for example, 40 mm thick, 1.6 m long and moves at a speed of 1 m/s. It arrives at a temperature of 925° C. and must be heated up to 1050° C.; this requires dissipation, within the product and on a short distance, a power of about 25 MW.

The rollers are fluid-cooled; they have a diameter of 400 mm and their longitudinal sequencing pitch is of 950 mm.

The inductor consists of 10 elements, each one inducing a power of 2.5 MW at 50 Hz and extending on a length of 1.25 m. The sheet metal plates of all these magnetic elements are 0.5 mm thick and insulated by oxidation according to the usual process. The inductor leaves a clearance of 150 mm above the product to be heated. The product bending between rollers is not shown on the figure. It is limited to 20 mm by the intermediate support plates.

The heated product is directed towards other rolling mills to be brought to a thickness of 10 mm.

Figure 9:
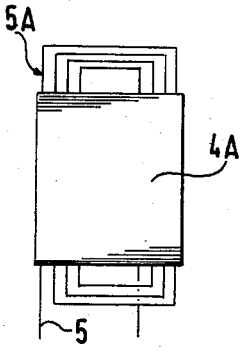
FIG. 9 is a plan view of the second construction inductor with distributed single-phase induction winding with concentric heads supplied with alternative current.

According to a second construction mode of this invention, it is possible to use, as shown on the plan view of FIG. 9, a succession of single-phase inductors with concentric coils 5A supplied with alternative current. These inductors are integrated, together with their magnetic circuits 4A instead of the inductors shown in FIG. 1.

Figure 10:
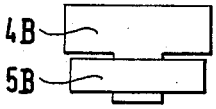
FIG. 10 is a front view of the third construction inductor with polar coils supplied with alternative current.
Figure 11:
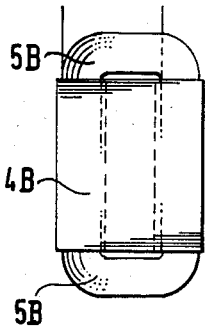
FIG. 11 is a plan view of the inductor shown in FIG. 10

According to a third construction mode, it is possible to use, as shown on the end view of FIG. 10 and the plan view of FIG. 11, polar coils 5B on cores supplied with alternative current. These coils are integrated, together with their magnetic circuits 4B, instead of the corresponding elements of FIG. 1.

Figure 12:
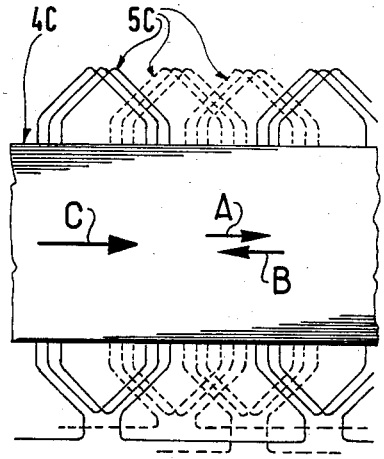
FIG. 12 is a plan view of a fourth construction inductor with three-phase induction winding supplied with alternative currents which determine a drift field parallel to the moving direction.

According to a fourth construction mode, the magnetic circuit of inductor 4C can bear a multiphase winding 5C, for example a three-phase type as shown on the partial view of FIG. 12. This winding generates a drift field of which direction A or B depends on the phase succession since it is the same or opposite to direction C of product conveyance. This magnetic circuit and its winding are integrated instead of the corresponding elements of FIG. 1. The winding can be carried out with concentric heads instead of overlapping heads as shown on FIG. 12.

Figure 13:
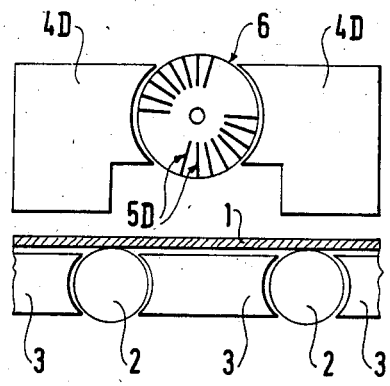
FIG. 13 is a side view of a fifth construction mode with an inductor in which a bipolar armature, bearing a distributed winding energized with direct current, generates, by its rotation, the flux variations.

According to a fifth construction mode, as shown on FIG. 13, the field coils 5D are born by a magnetic cylinder 6 which is not necessarily laminated and which is driven in rotation; the rest of the inductor magnetic circuit is represented in 4D.

Figure 14:
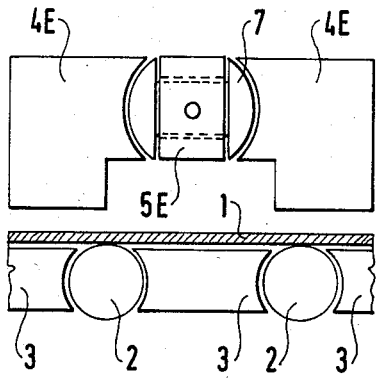
FIG. 14 is a side view of a sixth construction mode in which a bipolar armature with salient poles, energized by polar coils, generates, by its rotation, the flux variations.

According to a sixth construction mode, shown on FIG. 14, the field coils 5E are born by poles 7 which are not necassarily laminated and which are driven in rotation; the rest of the inductor magnetic ciucuit is represented in 4E.

In both cases, FIGS. 13 and 14, the coils are supplied with direct current. Thus, the reactive energy call, existing in the previous modes, is avoided. In these two case, the heating flux variation with appropriate frequency is obtained by rotation in a cylindrical space arranged in the magnetic circuit 4D or 4E with a very samll gap in relation to parts 6 or 7. In these two cases, the mobile parts are shown as bipolar elements but can include several pairs of poles.

Figure 15:
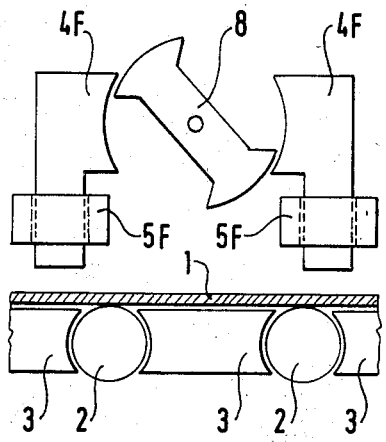
FIG. 15 is a side view of a seventh construction mode in which a fixed base flux, generated by DC supplied coils, is pulsed by rotation of a component having magnetic anisotrophy according to two normal axes.

According to a seventh construction mode, as for FIG. 15, the bipolar coils 5F are supplied with direct current. The flux variation is obtained by cyclic variation of the whole magnetic circuit reluctance. The variation i provoked by rotation of a magnetic part 8, which is laminated in the same direction as the rest of the circuit, and of which shape generates notable variation of the air gap in which it moves; this air gap is made out by the magnetic circuit 4F.

The shape shown on FIG. 15 and the location selected for the magnetic part 8 could of course be modified.

The rollers, the intermediate support plates and the support of the rollers bearings could also be made of different materials and have other shapes without departing from the teachings of the present invention.

I claim:

1. Induction heating apparatus for moving metal products, including:

conveyance rollers (2) for bearing and carrying along the products to be heated (1) in a longitudinal horizontal direction (DL); said rollers being one after the other and mounted for rotation around shafts (2X) which are parallel to a transverse direction, perpendicular to said longitudinal direction; said shafts being supported by end bearings, induction coils (5) supplied with electric current for generating a periodically variable magnetic flux, a looped magnetic circuit comprising a top section (4) of high magnetic conductivity elements and a spaced, bottom section (2, 3), the products to be heated passing over the rollers and between said sections, said sections forming flux loops which pass upwards and downwards and which close longitudinally, on top of and under the products, said rollers (2) being made of composite material and each including a magnetic stack and a stiffening element (21), said magnetic stack taking at least half of the roller volume and being made of high magnetic conductivity elements stacked on the roller axis so that the roller forms part of the looped magnetic circuit; said stiffening element being metallic, resisting at least the tension strains and extending in said transverse direction, the whole roller length inside the magnetic stack so that the roller resists the bending strains generated by the weight of the product to be heated, the improvement wherein said magnetic stack is a laminated stacking constituted by magnetic sheet metal plates, each plate of which having a thickness not in excess of 0.6 mm, and being electrically resistive, and isolated from each other so that the magnetic flux passing through the stack cannot heat it beyond the Curie point of said magnetic plates even when the products (1) are heated beyond 800° C., said stiffening element (21) being formed of a non-magnetic metal so that the magnetic flux through the roller is channelled by the magnetic sheet metal plates on both sides of said stiffening element and cannot heat the latter up to a temperature which might damage its mechanical properties, each conveyance roller (2) including, in addition, shielding cans (24) distributed across the whole roller length, being of refractory non-magnetic steel and presenting circular bearing edges (24A) coaxial to the roller and radially beyond the magnetic sheet metal plates to form a radial thermal insulation gap (24B) between the sheet metal plates and the products to be heated, born by these bearing edges, and a heat shield of thermal insulation arranged between the upper side of the product to be heated and a magnetic inductor circuit (4) forming the top section of said looped magnetic circuit above the product and being fitted with said induction coils (5).

2. Apparatus according to claim 1, in which the said stiffening element is a rigid shaft (21).

3. Apparatus according to claim 1, wherein said stiffening element (21) is permanently stressed by clamping flanges (22, 23) bearing on said magnetic stack (25) for ensuring pre-compression of sheet metal plates so that it participates in the roller stiffening (2).

4. Apparatus according to claim 1, wherein stationary intermediate support plates (3) are arranged in gaps between successive conveyance rollers (2) to limit the downward bending of a long flexible product, said intermediate support plates including ferromagnetic blocks (32) constituted by transverse stacking of magnetic sheet metal plates, normal to said transverse direction, and completing, with said conveyance rollers (2), said bottom section of said looped magnetic circuit under the products to be heated.

5. Apparatus according to claim 4, wherein each said intermediate support plate (3) includes refractory non-magnetic steel shielding cans (31) distributed along said transverse direction and protruding above said ferromagnetic blocks (32) to separate the products to be heated (1) and to define a thermal insulation gap adjacent said blocks and between said blocks and the product.

6. Apparatus according to claim 1, wherein each said conveyance roller (2) is fitted with cooling means (27A, 27B).

* * * * *